United States Patent [19]

Weiler

[11] 4,390,318

[45] Jun. 28, 1983

[54] APPARATUS FOR OPERATING SHUT-OFF MEMBERS IN GAS TURBINE ENGINES, PARTICULARLY IN TURBOJET ENGINES

[75] Inventor: Wolfgang Weiler, Dachau, Fed. Rep. of Germany

[73] Assignee: MTU Motoren-und Turbinen-Union Muenche GmbH, Munich, Fed. Rep. of Germany

[21] Appl. No.: 195,073

[22] Filed: Oct. 8, 1980

Related U.S. Application Data

[62] Division of Ser. No. 940,492, Sep. 7, 1978, Pat. No. 4,253,797.

[30] Foreign Application Priority Data

Sep. 10, 1977 [DE] Fed. Rep. of Germany ..... 2740904

[51] Int. Cl.[3] ..... F04D 29/56

[52] U.S. Cl. ..... 415/145; 415/28; 415/157

[58] Field of Search ..... 415/157, 158, 160–162, 415/145, 28; 60/226 B

[56] References Cited

U.S. PATENT DOCUMENTS

| | | | |
|---|---|---|---|
| 3,030,006 | 4/1962 | Shoup, Jr. | 415/145 |
| 3,057,541 | 9/1962 | Hasbrouck et al. | 415/145 |
| 3,066,488 | 12/1962 | Mock | 415/161 UX |
| 3,094,270 | 6/1963 | Kent et al. | 415/145 |
| 3,638,428 | 2/1972 | Shipley et al. | 415/145 X |
| 3,873,230 | 3/1975 | Norris et al. | 415/162 |
| 3,898,799 | 8/1975 | Pollert et al. | 415/145 X |

FOREIGN PATENT DOCUMENTS

| | | | |
|---|---|---|---|
| 1238897 | 7/1971 | United Kingdom | 60/226 B |

*Primary Examiner*—Philip R. Coe
*Assistant Examiner*—Joseph M. Pitko
*Attorney, Agent, or Firm*—Scully, Scott, Murphy & Presser

[57] ABSTRACT

An arrangement for operating shut-off members in gas turbine engines, particularly turbojet engines. Circumferential rotation of an actuating ring is converted into axial opening or closing movement by transmission element. These transmission elements are in the form of bellcranks which are pivotally supported in their elbow area on a fixed casing of the engine. A free arm end of each bellcrank is hinged to the actuating ring. Another free end of each bellcrank is hinged to a pull rod engaging at least one axially moveable shut-off member, or an axially adjustable shut-off element thereon. Two pull rods associated with respective shut-off members, are each pivotally connected on a side opposite the associated shut-off members at various points of an arm of the bellcrank. The arrangement is such that co-directional movement of the shut-off members produces different travels or strokes of the shut-off members.

2 Claims, 5 Drawing Figures

APPARATUS FOR OPERATING SHUT-OFF MEMBERS IN GAS TURBINE ENGINES, PARTICULARLY IN TURBOJET ENGINES

This is a division of application Ser. No. 940,492 filed Sept. 7, 1978, now U.S. Pat. No. 4,253,797.

BACKGROUND OF THE INVENTION

This invention relates to a mechanism for operating shut-off members in gas turbine engines, more particularly in turbojet engines, where circumferential rotation of an actuating ring is converted into an axially directed opening or closing movement by the intervention of transmission elements.

A mechanism of this description can be used, e.g., on variable-cycle turbojet engines. Variable-cycle turbojet engines have the feature that their thrust and consumption characteristics can be varied within a certain range. Variation of these characteristics is in part achieved by varying the mass flows in the engine, e.g., by varying the division of the mass flow downstream of the low-pressure compressor into core and bypass flows by means of a variable flow divider, partly by varying variable compressor and turbine stators, and also by the admission or interruption of air flows. This last provision is used, e.g., for bleeding air from the core engine and ducting it into the bypass flow or for affecting the flow of afterburner cooling air.

Shut-off members of this type must often be arranged in engine areas affording little space for their operation, especially where axial motion of large actuating members, such as actuating rings, is prevented. This is often aggravated by the fact that several such members must be actuated simultaneously. An important consideration with all arrangements is also that operation of the shut-off members should preferably not increase the outer diameter of the engine over that of an equivalent fixed-cycle engine and that the flow through the bypass duct should be disturbed as little as possible by detrimental fittings.

Accordingly, it is an object of the present invention to provide an operating mechanism of simple arrangement and moderate space requirement.

Another object of the present invention is to provide an arrangement of the foregoing character which may be economically fabricated and readily maintained in service.

A further object of the present invention is to provide an arrangement, as described, which has a substantially long operating life.

SUMMARY OF THE INVENTION

The objects of the present invention are achieved by providing an arrangement of that category where the transmission elements take the shape of bellcranks pivotally connected in their elbow area to a fixed casing section of the engine; a free leg end of each bellcrank is hinged to the actuating ring and another free leg end of each bellcrank to a pull rod engaging at least one axially displaceable shut-off member or an axially variable shut-off element thereof.

In further embodiments of the present invention there will then result, amongst others, co-directional movements of the shut-off members at different actuating travels (strokes) of the members, or simultaneous counter-directional actuating movements of the shut-off members at equal actuating travels (strokes) of the members, or simultaneous counter-directional actuating movements of the shut-off members at different travels (strokes) of the members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
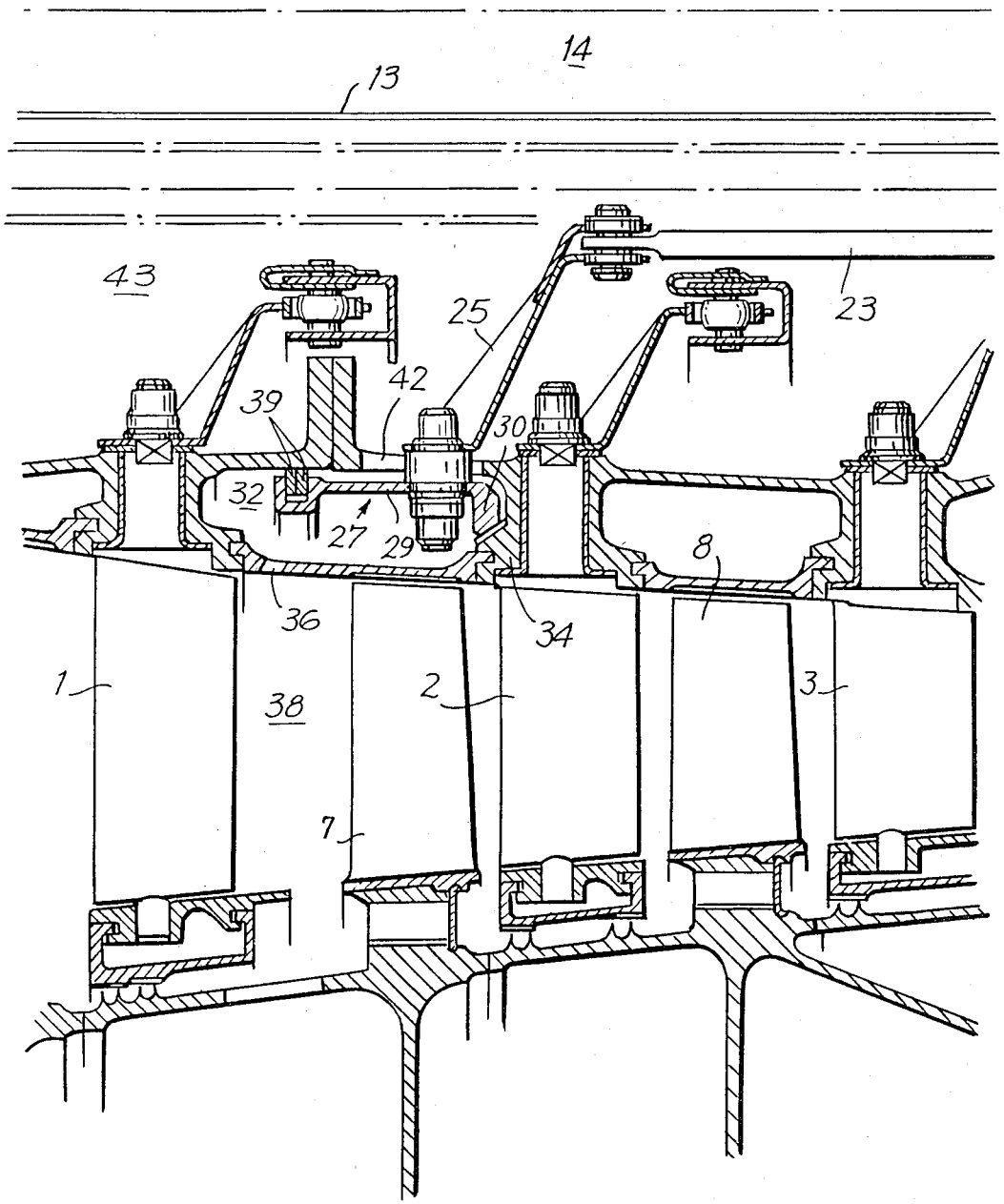
FIG. 1 is a longitudinal center section and illustrates a forward axial-flow compressor section forming part of the core engine plus portions of the bypass duct of a turbojet engine in association with a mechanism arranged in accordance with the present invention between the axial-flow compressor and the bypass duct.
Figure 2:
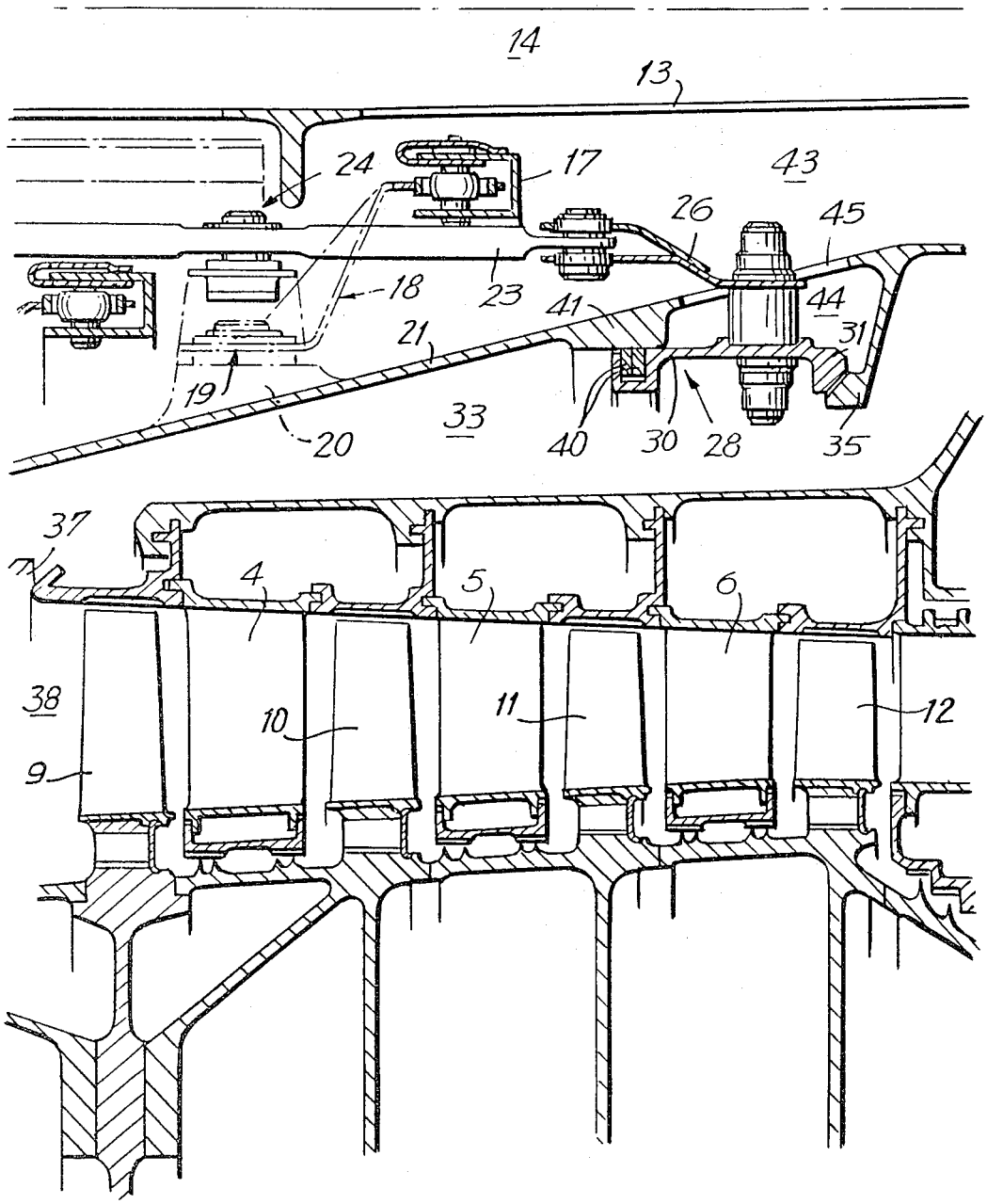
FIG. 2 illustrates the continuation of the longitudinal center section of the engine including the mechanism arranged between the axial-flow compressor and the bypass duct, as shown in FIG. 1.

With reference to FIGS. 1 and 2, a multiple-stage axial-flow compressor of a turbojet engine is controlled by means of, among others, variable guide vanes 1, 2, 3, where other, fixed guide vanes are indicated by the numerals 4, 5 and 6. The rotor blades of this axial-flow compressor are indicated from FIG. 1 to FIG. 2 consecutively by the numerals 7, 8, 9, 10, 11 and 12.

FIGS. 1 and 2 also outline the inner wall 13 of an outer bypass duct 14 which extends coaxially with the core engine and serves for the secondary circuit of the engine, and which is pressurized by a front fan omitted on the drawing.

Figure 3:
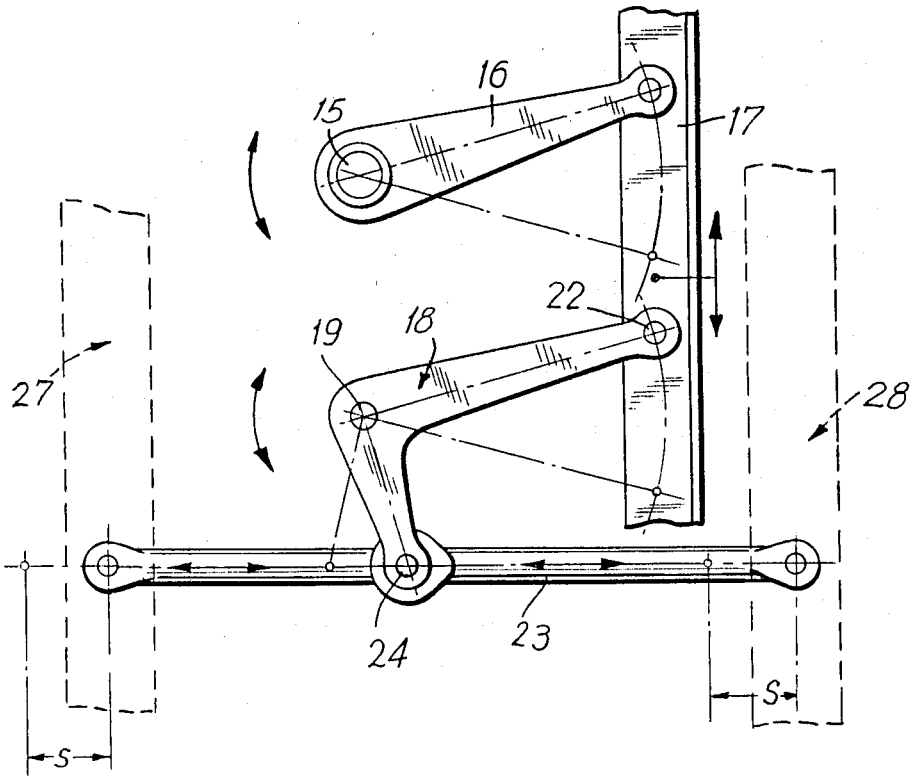
FIG. 3 is a plan view and illustrates details of a first embodiment of the mechanism applicable to FIGS. 1 and 2, in schematic arrangement.
Figure 4:
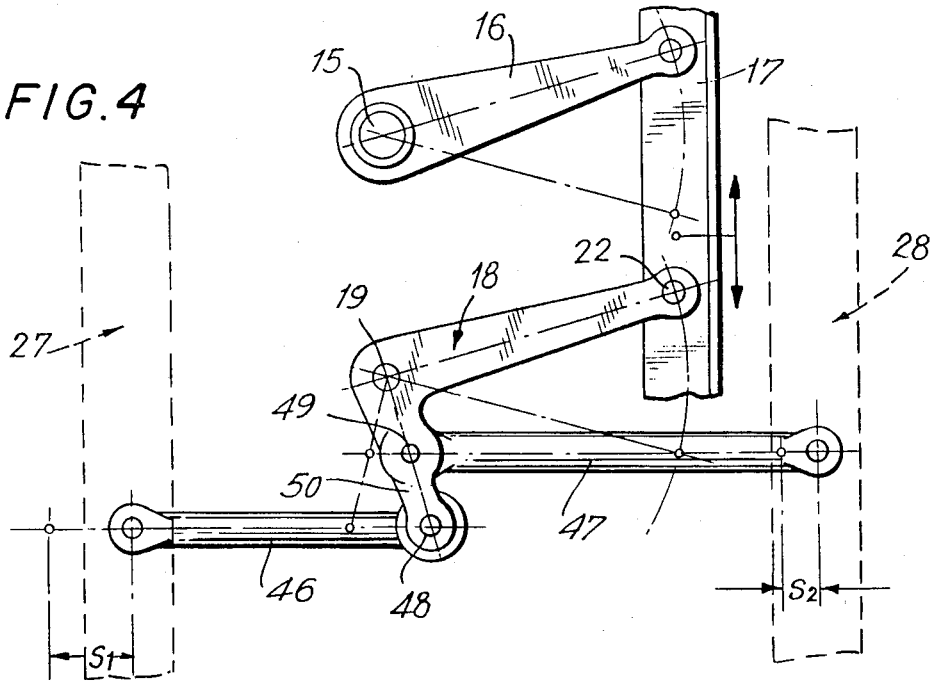
FIG. 4 is a plan view and illustrates details of a second embodiment of the mechanism in schematic arrangement.

Accommodated essentially between the inner wall 13 of the bypass duct 14 and outer structural casing components of the axial-flow compressor, is an embodiment of the mechanism as schematically reflected in FIG. 3, where for the first embodiment of the mechanism of FIGS. 1, 2 and 3, identical or similar components are indicated by the same numerals.

In accordance with FIG. 3 the actuating moment required to operate the mechanism is transferred, through at least one stub shaft 15 carried through the bypass duct 14 and rotatably supported in a casing shoulder of wall 13 omitted on the drawing, to a lever 16 which is pivotally connected to a circumferentially rotatable actuating ring 17.

Provided also are bellcranks 18 pivotally supported in their elbow area, which would here be point 19 (FIG. 3), on a casing shoulder 20 of a fixed casing section 21 (FIG. 2). A free leg end of the bellcrank 18 is hinged to the actuating ring 17 at point 22, the other free leg end of the bellcrank 18 to a pull rod 23 (pivot 24).

The pull rod 23 is connected at both ends, by means of inwardly offset fittings 25, 26 (FIGS. 1 and 2), to a first and a second shut-off member 27 and 28, respectively.

The shut-off members 27 and 28, respectively, are axially displaceable valve rings 29 and 30 arranged coaxially with the compressor centerline, arranged to the one end 30 or 31 at which are valve cones cooperating with associated valve cone ends 34, 35 on the compressor outer casing to shut-off or open casing chambers 32, 33. The casing chambers 32,33 communicate with the annular duct 38 of the axial-flow compressor by ports 36,37.

This mechanism accordingly permits, with simultaneous, co-directional movement of the shut-off members 27, 28 or of the valve rings 29, 30, equal valve strokes S (FIG. 3) to be adjusted, or the flow areas between the valve cone ends 30, 34 and 31, 35 to be simultaneously closed off entirely (FIGS. 1 and 2).

In accordance with FIGS. 1 and 2, the valve rings 29, 30 are provided with sealing rings 39, 40 which in all positions of the shut-off members 27, 28 will rest for sealing action on the upper wall of the casing chamber 32 or on the inner surface of a casing shoulder 41 on the fixed casing section 21.

Accordingly, when both valves are opened simultaneously by the shut-off members 27, 28 a portion of the compressor air from the annular duct 38 will on the one hand flow, through the port 36, into the casing chamber 32 and from there, through the flow area opened by the two valve cone ends 30, 34 and through a chamber port 42, into the annulus 43 which communicates with the bypass duct 14 through means omitted on the drawing. On the other hand, a portion of the compressor air from the annular duct 38 of the axial-flow compressor will flow, through port 37, into another casing chamber 33 and from there, through the flow area opened by the two valve cone ends 31, 35 and a further annulus 44 and a port 45 in the casing section 21, into the annulus 43. The latter communicates with the bypass duct 14.

FIGS. 1, 2 and 3 accordingly illustrate a practicable approach to controlling the compressor by actuating the guide vanes and by bleeding compressor air.

Using the same numerals to indicate components which remain essentially unchanged from those in FIGS. 1, 2 and 3, FIG. 4 illustrates an alternative embodiment of the mechanism. The first and the second shut-off members 27, 28 are connected to associated first and second pull rods 46, 47 and the first and second pull rods 46, 47 are each pivotally connected, on the side pointing away from the associated shut-off member 27, 28, at different points 48, 49 of a leg 50 of the bellcrank 18 such that simultaneous, co-directional movement of the shut-off members 27, 28 will produce different travels or strokes $S_1$, $S_2$ of the two valves.

Figure 5:
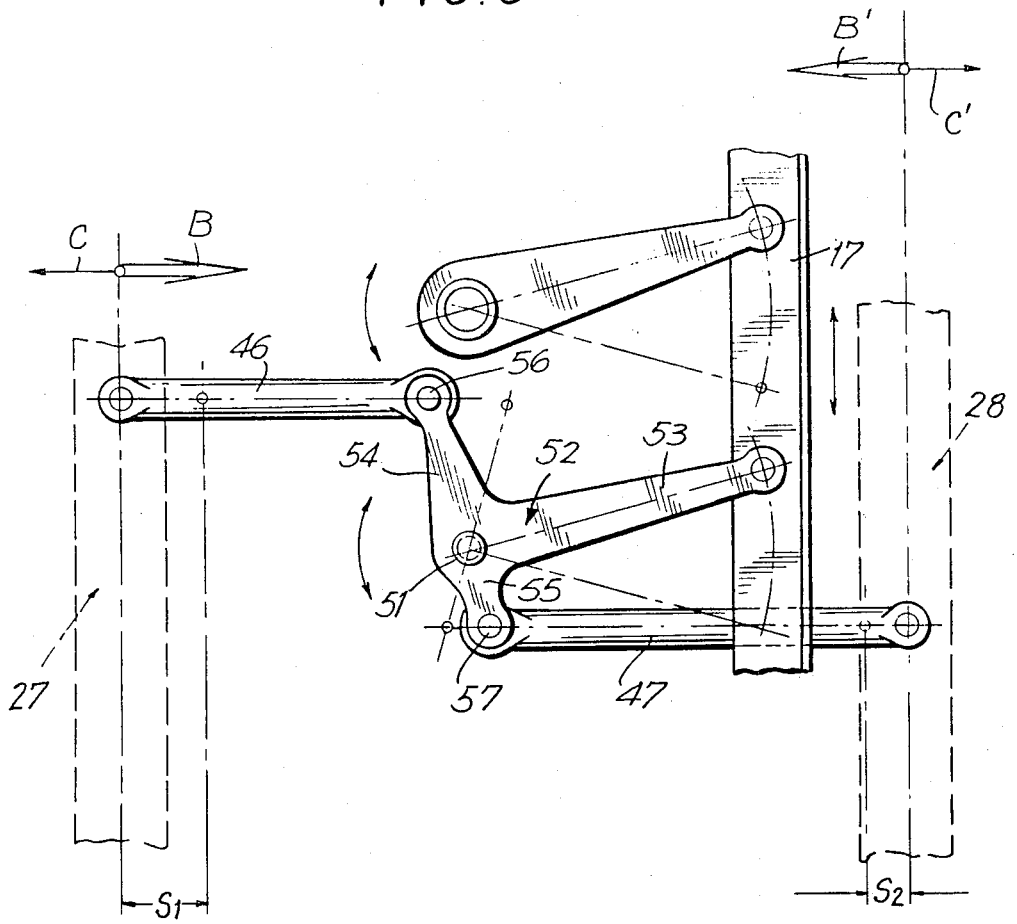
FIG. 5 is a plan view and illustrates details of a third embodiment of the mechanism of the present invention in schematic arrangement.

FIG. 5 illustrates an alternative embodiment, where at least one bellcrank 52 pivotally supported at point 51 on the casing has a leg 53 engaging with the actuating ring 17 plus two legs 54, 55 of different lengths. These are arranged opposite one another across the fulcrum 51 to provide pivotal points 56, 57 for the pull rods 46, 47 with different distances from the bellcrank fulcrum 51.

In this manner, simultaneous counter-directional movement (B—B' or C—C') of the two shut-off members 27, 28 will produce different travels or strokes $S_1$, $S_2$.

Another version of the mechanism illustrated in FIG. 5 would be adjustable such that the two legs of the bellcrank arranged oppositely one another across the fulcrum 51 would be equal in length for an equal spacing from fulcrum 51 of the pivotal points 56, 57 of two pull rods 46, 47 on the two legs of the bellcrank.

This would make it possible to achieve the same strokes at simultaneous counter-directional movement (B—B' or C—C') of the shut-off members 27, 28.

Regarding the embodiment of FIGS. 1 to 5 it should be noted that in the interest of uniform transmission of the actuating moment to the shut-off members and to prevent canting and binding of the shut-off members or valve rings during actuation, the total actuating moment required should preferably be transmitted through at least two diametrically opposite stub shafts on the circumference of the compressor, to the levers connected to these shafts. For this purpose, several bellcranks will pull rods are pivotally connected thereon. The bellcranks are spaced as equally as possible over the circumference of the casing affected.

The inventive concept naturally embraces, in lieu of the shut-off members exemplified above, also other shut-off members which could be actuated in accordance with this invention. These would be for example, shut-off flaps provided as flow dividers in jet engines, which are intended to simultaneously close or open different flow areas, or admit different mass flows to separate engine circuits. For functions like or similar to these, it would be equally possible to operate, for example, several shut-off valves in accordance with the present invention.

Without further analysis, the foregoing will so fully reveal the gist of the present invention that others can, by applying current knowledge, readily adapt it for various applications, without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is

1. Apparatus for controlling the movement of first and second shut-off members which can block and unblock gas-flow passages of a turbo engine to a selectable extent, comprising a first and a second shiftable pull rod each coupled to one of the shut-off members; a turnable actuating ring; a pair of bellcranks each having an elbow area swingable about a fixed pivot, and two free arms; means articulately connecting one of said free arms of each bellcrank to one of said rods; and means articulately connecting the other of said free arms of each bellcrank to said ring, said first and second pull rods each being connected to the respective bellcranks at different locations of the latter so that co-directional movement of the shut-off members results in different travel strokes of such members.

2. Apparatus for controlling the movement of first and second shut-off members which can block and unblock gas-flow passages of a turbo engine to a selectable extent, comprising transmission elements; actuating ring means with rotation converted into axial opening and closing movement by said transmission elements, said transmission elements comprising bellcranks with elbow areas pivotally supported on a fixed casing section of the engine; each bellcrank having one arm engaging said actuating ring means and two additional arms arranged oppositely one another across the pivoting point of the bellcrank, one of said additional arms being hinged to one pull rod engaging a first one of said shut-off members and the other one of said additional arms being hinged to a pull rod engaging a second one of said shut-off members so as to produce simultaneous counter-directional actuating movement of said rods and thereby said shut-off members.

* * * * *